US006502523B1

(12) United States Patent
Robb

(10) Patent No.: US 6,502,523 B1
(45) Date of Patent: Jan. 7, 2003

(54) ROAD-TOWED HEAVY FERRY

(76) Inventor: Gary K. Robb, 2040 Williams St., San Leandro, CA (US) 94577

( * ) Notice: Subject to any disclaimer, the term of this patent is extended or adjusted under 35 U.S.C. 154(b) by 0 days.

(21) Appl. No.: 09/722,830

(22) Filed: Nov. 27, 2000

(51) Int. Cl.[7] ..... B63B 35/28
(52) U.S. Cl. ..... 114/26; 114/61.1
(58) Field of Search ..... 114/26, 61.15, 114/61.16, 61.17, 61.1, 344, 125; 440/11, 53, 7

(56) References Cited

U.S. PATENT DOCUMENTS 1,602,812 A * 10/1926 Cook ..... 114/61.15
3,067,439 A 10/1962 Brush
3,193,851 A * 7/1965 Fiebelkorn ..... 114/61.15
3,332,388 A * 7/1967 Moraski ..... 440/11
3,763,511 A 10/1973 Sisil
3,828,719 A * 8/1974 Cooke ..... 440/61
3,908,577 A 9/1975 Struyk
3,987,748 A * 10/1976 Carroll ..... 440/11
4,314,519 A * 2/1982 Yunoki et al. ..... 114/125
4,621,385 A * 11/1986 Gillois ..... 14/2.6
4,681,054 A * 7/1987 Rice et al. ..... 114/124
5,111,763 A * 5/1992 Moerbe ..... 114/246
6,132,267 A * 10/2000 Campbell ..... 114/347

* cited by examiner

*Primary Examiner*—Stephen Avila
(74) *Attorney, Agent, or Firm*—James C. Peacock, III; O'Banion & Ritchey

(57) ABSTRACT

The road-towed heavy-load ferry may be produced in larger or smaller versions using the same design. Its basic embodiment can transport afloat loads exceeding 16 metric tons (17.6 tons) including its tow vehicle. The ferry essentially comprises three longitudinal hulls. Outboard hulls (12) pivot outward and inward to rest atop central hull (10). Thereby, the ferry is reduced to a width suitable for towing on public roads. Equipment for road towing includes telescoping towing tongue (32), and pneumatic-tired wheels (28) which remain intact afloat. Winch (40) enables kedging across shoal water or ground. The wheels extend below the deployed outboard hulls to assist in kedging by reducing friction, suction, and risk of hull damage. A water-ballast system counterbalances on-board loads and otherwise improves stability in adverse winds, waves, and currents. Hinged gunwales provide additional freeboard.

2 Claims, 5 Drawing Sheets

ROAD-TOWED HEAVY FERRY

CROSS-REFERENCE TO RELATED APPLICATIONS

Not applicable.

STATEMENT REGARDING FEDERALLY SPONSORED RESEARCH AND DEVELOPMENT

Not applicable.

REFERENCE TO MICROFICHE APPENDIX

Not applicable.

BACKGROUND—FIELD OF INVENTION

This invention relates to amphibious transportation, specifically to movement of a land vehicle and/or substantial cargo on land and water.

BACKGROUND—DESCRIPTION OF PRIOR ART

A recent patent search and prior art investigation included over 600 patent abstracts, patents, and magazine/newspaper articles, wherein many ingenious inventions were reviewed. Three representative patents are discussed below which the applicant believes are pertinent due to features like some of those included in this application.

U.S. Pat. No. 3,908,577 to Struyk (1975) titled "Land and Water Transport" discloses:

(a) " . . . a means for floating and transporting a land vehicle to thus convert the same to an amphibious vehicle. . . "

(b) " . . . that other vehicles, such as a trailer, tractor, etc. may be supported on the structure of the present invention for travel thereof over a body of water . . . ."

Disadvantages of Struyk's invention include:

(a) cumbersome pre-launch and post-landing processes of assembling and disassembling several individual components, (b) a relatively complex design, (c) lack of flotation and strength for moving substantial cargo, (d) lack of features for operating in adverse situations.

U.S. Pat. No. 3,067,439 to Brush (1962) titled "Foldable Catamaran" discloses the ability to carry an automobile. Disadvantages include:

(a) a relatively complex design, (b) lack of flotation and strength for moving substantial cargo, (c) lack of features for operating in adverse situations.

U.S. Pat. No. 3,763,511 to Sisil (1973) titled "Foldable and Trailerable Pontoon Boat" discloses a pair of winch-deployed pontoons, movable " . . . between an inner folded position inboard of the main deck and an extended position below and outboard of the [sic] main deck . . . . " Disadvantages include:

(a) the necessity of leaving the boat's trailer at the launch site, (b) lack of flotation and strength for moving substantial cargo, (c) lack of features for operating in adverse situations.

The following paragraph applies to amphibious vehicles which are self-propelled on both land and water.

Recreational/utilitarian amphibious vehicles are typically too small and underpowered for use on public roads or for moving substantial cargo. Also, they lack features for coping with adverse conditions. Military-type amphibious vehicles are generally too large, heavy, and slow, for road use—a notable exception being the familiar "Duck" (DUKW). Apart from road-use limitations, such specialized vehicles often require unusual repair items and maintenance expertise.

The next paragraph, based on the applicant's personal experience, relates to existing equipment and methods for moving cargo on both land and water in conventional marine operations.

Frequently, marine operations such as dredging, diving, oil well drilling, hazardous material cleanup, breakwater construction, etc., are away from any truck-accessible location. Often, work must be interrupted while the operation's derrick barge and pusher boat, or the equivalent, rendezvous with a cargo truck. This wastes time, money, and fuel. Also, it increases fuel-combustion pollution in areas which may be already polluted or environmentally sensitive.

SUMMARY

This application is for a road-towed self-propelled barge. The barge can be towed on public roads and can propel afloat a vehicle such as a tow vehicle, and substantial cargo. It can accomplish such movement on land and water, and transition therebetween, in a safe and efficient manner despite adverse conditions. Furthermore, it is relatively simple and cost-effective to build and maintain.

OBJECTS AND ADVANTAGES

The basic object of the road-towed self-propelled barge is to enable safe and practical movement of cargo and equipment on land including public roads and on bodies of water. In addition to protection of human life and property, far-reaching benefits discussed shortly include safeguarding the natural environment, increased agricultural production, reduced waste of natural resources, and financial savings.

An important object and advantage of the barge is the transportation afloat, despite adverse conditions, of a variety of relatively-heavy special-purpose vehicles and equipment, from the most expedient launch point. This would be extremely valuable to search and rescue units, emergency medical services, fire and police departments, hazardous material response teams, etc.

Additionally, this cost-effective, environmentally low-impact device for amphibious transportation of equipment, cargo, and vehicles would facilitate:

(a) better monitoring and protection of wetland and wildlife areas, (b) reuse of idle farmlands not otherwise economically accessible, (c) secondary and tertiary oil production from abandoned oil fields not otherwise economically accessible.

Scientific, military, and commercial expeditions could use the barge to ferry vehicles and equipment. Many other uses of the barge may be easily visualized, such as those related to educational and recreational pursuits.

Another advantage of the road-towed self-propelled barge is its water-ballast system for adjusting fore-and-aft trim and port-and-starboard list. This feature is useful for counterbalancing on-board loads, for extrication from grounding, and for improving stability in adverse winds, waves, and currents.

A further advantage of the barge is its relatively simple design with extensive use of conventional items and installations.

Basic advantages of the barge over prior art are:

(a) regarding U.S. Pat. No. 3,908,577 to Struyk (1975):
  (1) to move a land vehicle from land to water to land repeatedly, without excessive time and effort in transition,
  (2) to use a comparatively simple design,
  (3) to move substantial cargo,
  (4) to operate in adverse situations;

(b) regarding U.S. Pat. No. 3,067,439 to Brush (1962):
  (1) to use a comparatively simple design,
  (2) to move substantial cargo,
  (3) to operate in adverse situations;

(c) regarding U.S. Pat. No. 3,763,511 to Sisil (1973):
  (1) to launch a watercraft without leaving its trailer at the launch site,
  (2) to carry a vehicle capable of towing such a watercraft on land,
  (3) to move substantial cargo,
  (4) to operate in adverse situations;

(d) regarding recreational/utilitarian amphibious vehicles:
  (1) to allow relatively unlimited use of public roads,
  (2) to use a conventional vehicle for movement on land,
  (3) to use common repair items and maintenance expertise,
  (4) to move substantial cargo,
  (5) to operate in adverse situations;

(e) regarding military-type amphibious vehicles:
  (1) to allow relatively unlimited use of public roads,
  (2) to use a conventional vehicle for movement on land,
  (3) to use common repair items and maintenance expertise;

(f) regarding existing equipment and methods for moving cargo on both land and water in conventional marine operations:
  (1) to permit delivery of cargo, with minimal work interruption, to a water-isolated job site,
  (2) to permit delivery of cargo to a water-isolated job site at reduced fuel, equipment, and personnel costs,
  (3) to reduce idle-equipment costs by using a barge which can be efficiently moved on land to other job sites,
  (4) to reduce repair and maintenance costs by using a barge which can be efficiently moved on land to a workshop,
  (5) to reduce hull maintenance costs and the risk of heavy-weather damage by using a barge which can be efficiently moved ashore,
  (6) to reduce security costs and risks of theft and vandalism by using a barge which can be efficiently moved on land to a safe location,
  (7) to reduce fuel-combustion pollution by using a launch point closer to a job site than a rendezvous point for a derrick barge and pusher boat (or the equivalent) and a cargo truck,
  (8) to reduce fuel-combustion pollution by using a relatively fuel-efficient cargo watercraft,
  (9) to enable environmentally low-impact cargo delivery across land and water in areas having few access routes.

DRAWING FIGURES

DESCRIPTION OF INVENTION

Numerals in Drawings and Text

Figure 1:
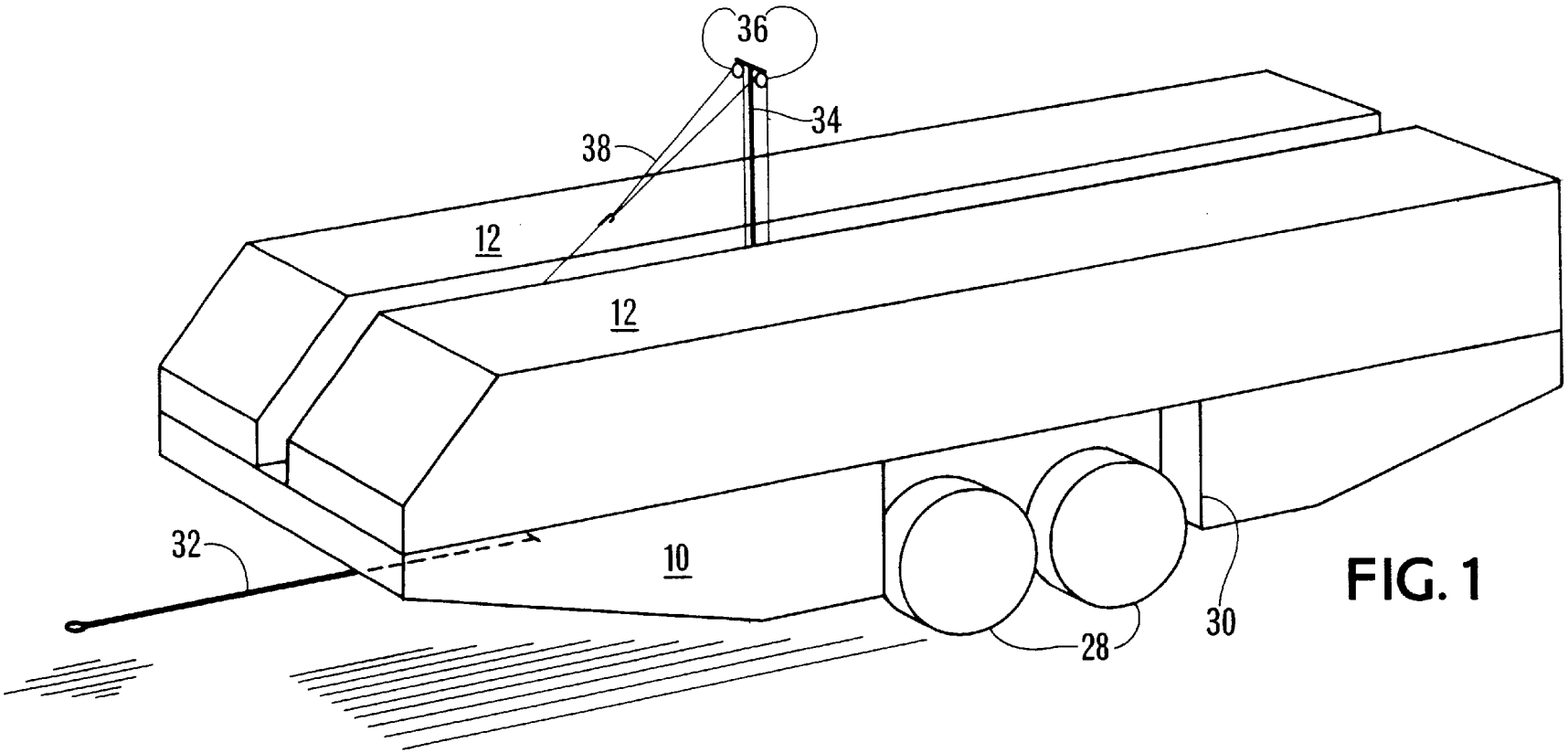
FIG. 1 is a perspective view showing the bow, port side, and top, of the barge in its land mode.

Note: Numerals are in the order that they appear in the text (#100 deleted).

| | | | |
|---|---|---|---|
| 10 | central hull | 12 | outboard hulls |
| 14 | main frame | 16 | heavy frame |
| 18 | forward flotation compartment | 20 | outer flotation compartments |
| 22 | aft flotation compartment | 24 | suspension systems |
| 26 | axles | 28 | pneumatic-tired wheels |
| 30 | wheel wells | 32 | towing tongue |
| 34 | kingpost | 36 | snatch blocks |
| 38 | wire-rope bridle | 40 | winch |
| 41 | winch compartment | 42 | bow compartment |
| 44 | mast | 46 | anchor light |
| 48 | radar transceiver | 50 | masthead light |
| 52 | locking mast pivot | 54 | mast-stabilizing bipod |
| 56 | mast-stabilizing strut | 58 | control/display panel |
| 60 | machinery compartment | 62 | stern compartment |
| 64 | lifeline posts | 66 | port and starboard lifelines |
| 68 | stern lifeline | 70 | starboard vehicle ramp |
| 72 | central-hull bow gunwale | 74 | outboard-hull gunwales |
| 76 | central-hull stern gunwale | 78 | hull-lock access wells |
| 80 | hull locks | 82 | tongue pin access well |
| 84 | tongue pin | 86 | fathometer transducer |
| 88 | water-ballast pump | 90 | propulsion/steering units |
| 92 | battery bank | 94 | forward water-ballast tanks |
| 96 | main fuel tank | 98 | outer fuel tanks |
| 102 | aft water-ballast tanks | 104 | hull-lock "keyholes" |
| 106 | tongue housing | 114 | alternative central hull |
| 108 | tongue housing/main frame forward junction | 118 | port inflatable bellows |
| 110 | tongue housing/main frame aft junction | | |
| 112 | alternative towing tongue | | |
| 116 | port alternative outboard hull | | |

Preface

As mentioned in the Objects and Advantages section, the road-towed self-propelled barge comprises numerous conventional items and installations. They are familiar to persons skilled in the arts of boat and trailer construction and cargo handling. Industry standards and legal requirements govern materials, equipment, and construction/installation practices pertaining to the barge. Accordingly, the applicant believes that various items and installations need not be described or shown in detail. Such items may be drawn in idealized form or merely their positions outlined; or they may only be referred to in the text.

For convenience of the examiner, items and installations pertaining to the barge which are not described or shown in detail, but otherwise indicated and/or enable proper functioning of the barge, are summarized below:

(a) tires, wheels, brakes, axles, suspension systems, and "road" lights;

(b) radar, fathometer, winch, battery bank, water-jet propulsion/steering units, water-ballast pump, control display panel with umbilical cord, and navigation lights;

(c) wiring, piping, and associated components, tank baffles, sacrificial anodes, reinforcing plates and gussets, flotation foam, hinges and pivots, vehicle ramps, hatches and cover plates, securing devices, deck cleats and fairleads, mooring lines, anchors, various rigging, towing tongue, alternate-embodiment towing tongue and inflatable bellows, and installation sockets of the mast, mast-stabilizing bipod, mast-stabilizing strut, lifeline posts, and kingpost;

(d) items in the Operation of Invention section including a tow vehicle, on-board loads such as vehicles and equipment, a lever-action chain binder, rigging points on the outboard hulls, and a dinghy.

Basic Construction

Figure 9:
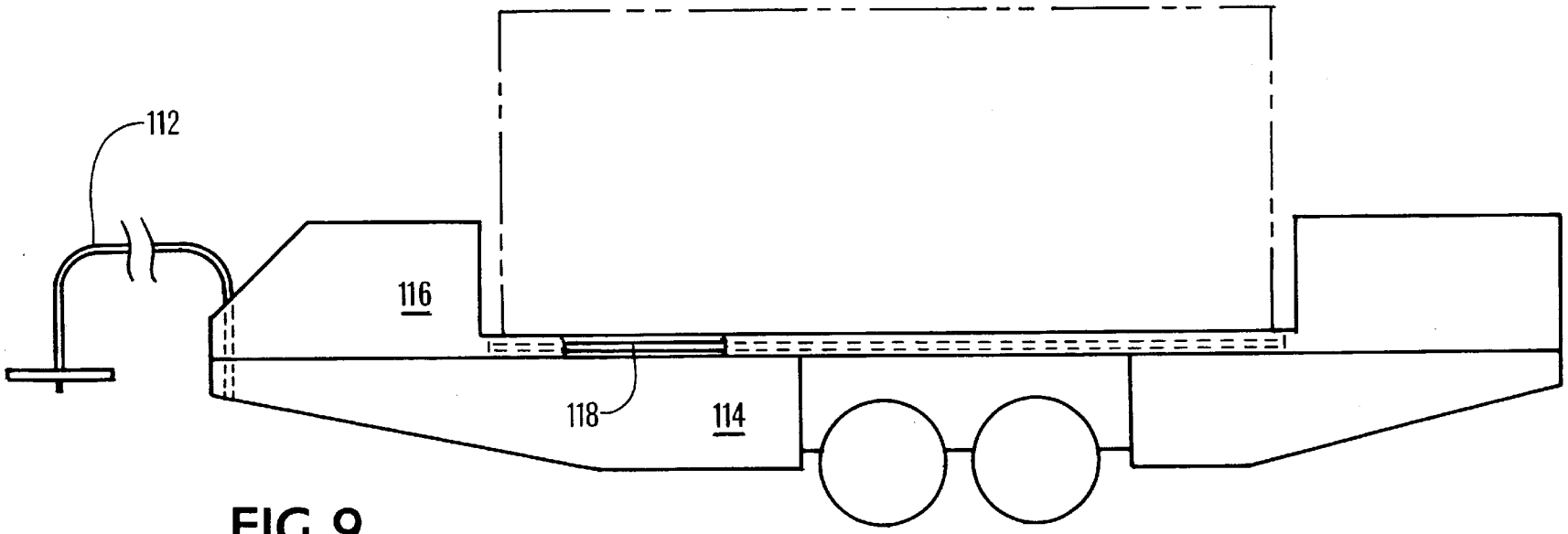
FIG. 9 is an orthogonal port-side view of the land mode of an alternative embodiment of the barge.

Note: Metric dimensions in this sub-section are rounded to the nearest millimeter. FIG. 9 is not included in the references to drawing figures.

The barge's central hull 10 (FIGS. 1, 2, 3, 4, and 5) and outboard hulls 12 (FIGS. 1, 2, 3, 4, and 5) are primarily constructed of welded-together aluminum plate and hollow aluminum framework. Conventional sacrificial anodes are installed near contacting dissimilar metals to inhibit galvanic corrosion.

The plate is 6 mm (¼ inch) thick or 3 mm (⅛ inch) thick. To simplify the text, such plate will respectively be called "heavy" or "light."

Heavy plate is used where load-bearing strength and/or resistance to damage is critical. Such areas include tank and compartment walls shown in the drawings and all external surfaces of the barge in its water mode. Light plate is primarily used for tank baffles and minor compartment walls (none shown).

Likewise, framework will be called "heavy" or "light" meaning, respectively, 6 mm (¼ inch) wall and 51 mm by 51 mm (2 inch by 2 inch) cross-section, or 3 mm (⅛ inch) wall and 25 mm by 25 mm (1 inch by 1 inch) cross-section. Main frame 14 (FIG. 7) has a wall thickness of 13 mm (½ inch) and cross-section of 76 mm by 152 mm (3 inch by 6 inch).

The main frame and heavy frame 16 (FIG. 6 and portions shown in FIG. 7) resist torsion, tension, and compression. The heavy frame also secures most tank and compartment walls shown in the drawings. Light frames primarily secure tank baffles and minor compartment walls (none shown).

Flotation compartments 18, 20, and 22 (FIG. 4), and outboard hulls contain closed-cell foam which solidifies after being installed in a fluid state.

Discussion of Drawing FIGS. 1 through 8—Preferred Embodiment

This paragraph and the next three apply to FIGS. 1 through 8. For clarity and simplicity, various items are omitted from drawing figures. Removable equipment is shown installed but not stowed (e.g., mast stabilizing members).

"This sub-section applies to FIGS. 1 through 8." Since the applicant requests the entire page be replaced, this minor editorial change is also submitted; the whole subsection applies to FIGS. 1 through 8.

Other items omitted from figures where they would have been visible will be pointed out in the following subsections.

Some items mentioned in the discussion of a figure may be also shown, or only shown, elsewhere. The relevant figure(s) will be identified in parentheses.

FIG. 1

FIG. 1 is a perspective view of the road-towed self-propelled barge in its land mode. It shows the top, port side, and bow. Hull locks are omitted.

Figure 4:
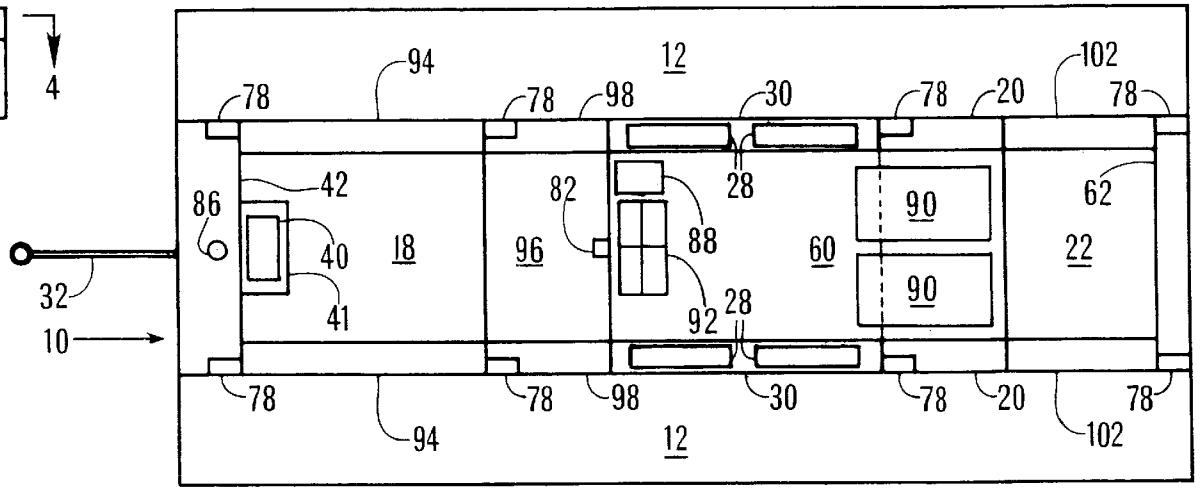
FIG. 4 is an orthogonal, cut-away top view of the barge in its water mode, the upper deck being omitted as indicated by line 4—4 in FIG. 3.
Figure 5:
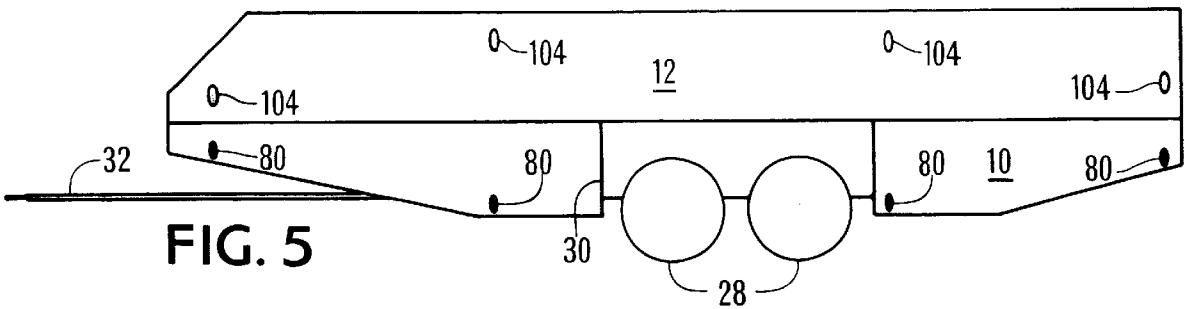
FIG. 5 is an orthogonal port-side view of the barge in its land mode.

Central hull 10 (also FIGS. 2, 3, 4, and 5) is attached by suspension systems 24 (only FIG. 7) to axles 26 (only FIG. 7), on which are shown port pneumatic-tired wheels 28 (also FIG. 3, 4, and 5) within port wheel well 30 (also FIGS. 4 and 5).

Extending from the bow is retractable towing tongue 32 (also FIGS. 3, 4, 5, and 8). Outboard hulls 12 (also FIGS. 2, 3, 4, and 5), carried atop the central hull, are attached by hinges along the upper outboard edges of the central hull deck. Parallel lines beneath the central hull and towing tongue indicate ground level.

Kingpost 34 is shown in position to deploy the outboard hulls using snatch blocks 36, wire-rope bridle 38, and a cable from winch 40 (only FIG. 4).

FIG. 2

Figure 2:
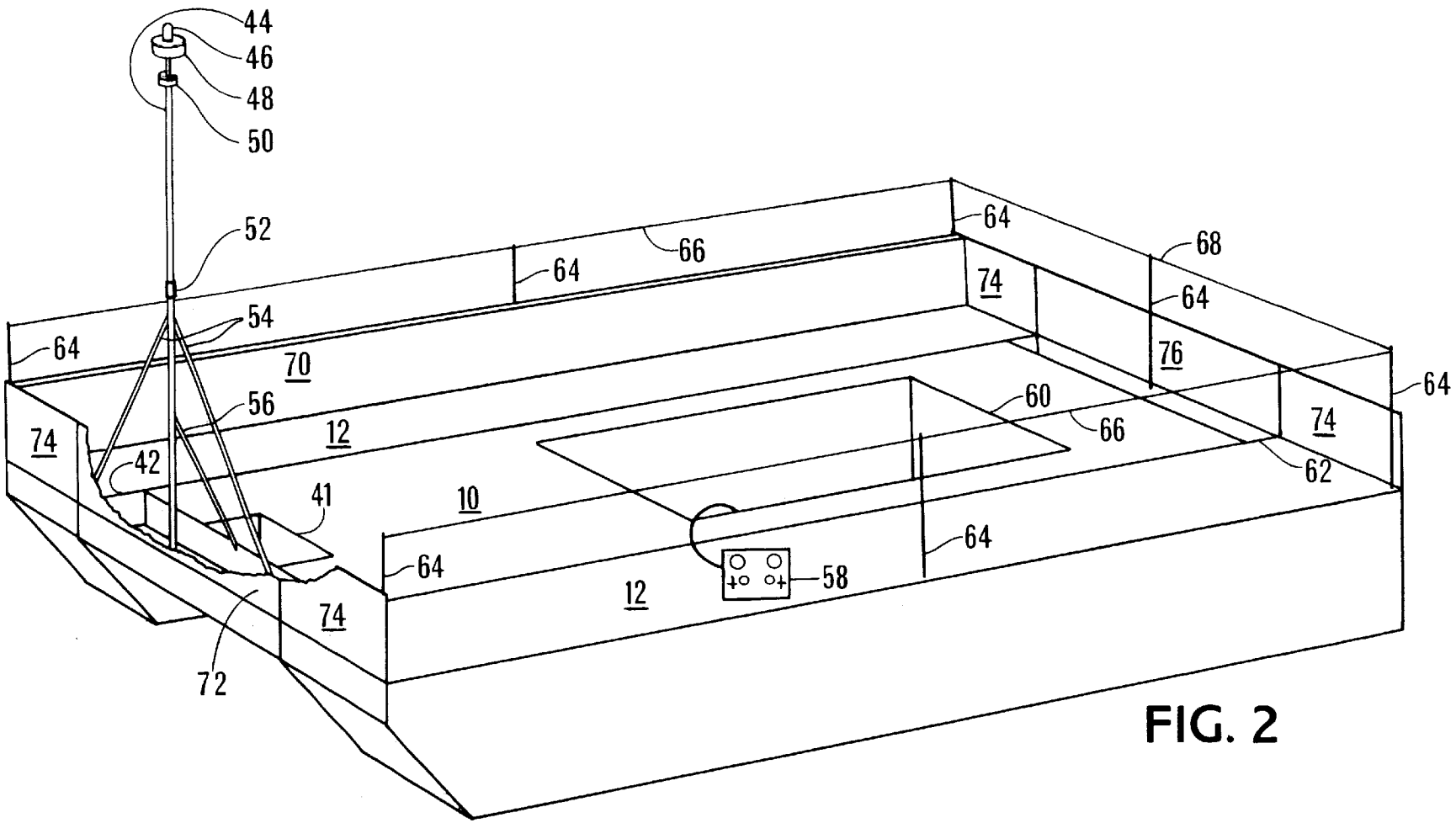
FIG. 2 is a perspective view showing the bow, port side, and top of the barge in its water mode.

FIG. 2 is similar to FIG. 1, but shows the barge in its water mode. Items not shown include below-deck equipment (only FIG. 4) and members of heavy frame 16 (only FIGS. 6 and 7), which would have been visible with the hatches omitted.

Items in FIG. 2 are central hull 10 (also FIGS. 1, 3, 4, and 5), hinged outboard hulls 12 (also FIGS. 1, 3, 4, and 5), winch compartment 41 (also FIG. 4), bow compartment 42 (also FIG. 4), mast 44, anchor light 46, radar transceiver 48, masthead light 50, locking mast pivot 52, mast-stabilizing bipod 54, mast-stabilizing strut 56, control/display panel with umbilical cord 58, machinery compartment 60 (also FIG. 4), stern compartment 62 (also FIG. 4), lifeline posts 64, port and starboard lifelines 66, and stern lifeline 68 (bow lifeline not shown).

Starboard vehicle ramp 70 is fastened to lifeline posts on the starboard side (port ramp not shown). Fastened to the mast and lifeline posts are central-hull bow hinged gunwale 72, outboard-hull hinged gunwales 74, and central-hull stern hinged gunwale 76, (portions omitted and hinges not shown).

FIG. 3

Figure 3:
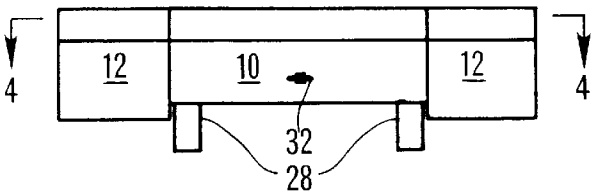
FIG. 3 is an orthogonal bow view of the outboard hulls, central hull, and wheels, in the barge's water mode.

FIG. 3 is an orthogonal, water-mode bow view of central hull 10, (also FIGS. 1, 2, 4, and 5), hinged outboard hulls 12 (also FIGS. 1, 2, 4, and 5), retractable towing tongue 32 (also FIGS. 1, 4, 5, and 8), and wheels 2 8 (also FIGS. 1, 4, and 5).

FIG. 4

FIG. 4 is an orthogonal, cut-away top view of the barge in its water mode. The upper deck is omitted as indicated by line 4—4 in FIG. 3. Axles 26 (only FIG. 7) which would have been marginally visible are omitted, as are tank baffles, installation sockets of the mast and mast-stabilizing bipod, and all frame members. Closed-cell foam is installed but not shown in forward flotation compartment 18, outer flotation compartments 20, aft flotation compartment 22, and outboard hulls 12 (also FIGS. 1, 2, 3, and 5).

Walls of tanks and compartments are shown, as are access wells 78 of hull locks 80 (only FIG. 5), access well 82 of tongue-securing pin 84 (only FIG. 8), fathometer transducer 86, and retractable towing tongue 32 (also FIGS. 1, 3, 5, and 8). Central hull 10 (also FIGS. 1, 2, 3, and 5) is indicated by a lead line with an arrowhead to distinguish it from tanks and compartments within the central hull.

Installed in machinery compartment 60 (also FIG. 2) are water-ballast pump 88, waterjet propulsion/steering units 90, and battery bank 92.

Outboard of the machinery compartment are outer flotation compartments 20, wheel wells 30 (also FIGS. 1 and 5), and pneumatic-tired wheels 28 (also FIG. 1, 3, and 5).

Forward of the machinery compartment are forward water-ballast tanks 94, forward flotation compartment 18, main fuel tank 96, outer fuel tanks 98, winch 40, and winch compartment 41 (also FIG. 2).

Aft of the machinery compartment are aft water-ballast tanks 102, aft flotation compartment 22, and stern compartment 62 (also FIG. 2).

FIG. 5

FIG. 5 is an orthogonal, port-side view of the barge in its land mode. Items in FIG. 5 are central hull 10 (also FIGS. 1, 2, 3, and 4), retractable towing tongue 32 (also FIGS. 1, 3, 4, and 8), port wheel well 30 (also FIGS. 1 and 4), port pneumatic-tired wheels 28 (also FIGS. 1, 3, and 4), hinged port outboard hull 12 (also FIGS. 1, 2, 3, and 4), and (exaggerated in size) port hull-locks 80, and port hull-lock "keyholes" 104. The hull-locks are conventional items used to attach multi-mode shipping containers to trailers etc. One such locking device is described in U.S. Pat. No. 4,697,967 to Schulz et al (1987) titled "Container Lock" (Enclosure 1*a*).

FIG. 6

Figure 6:
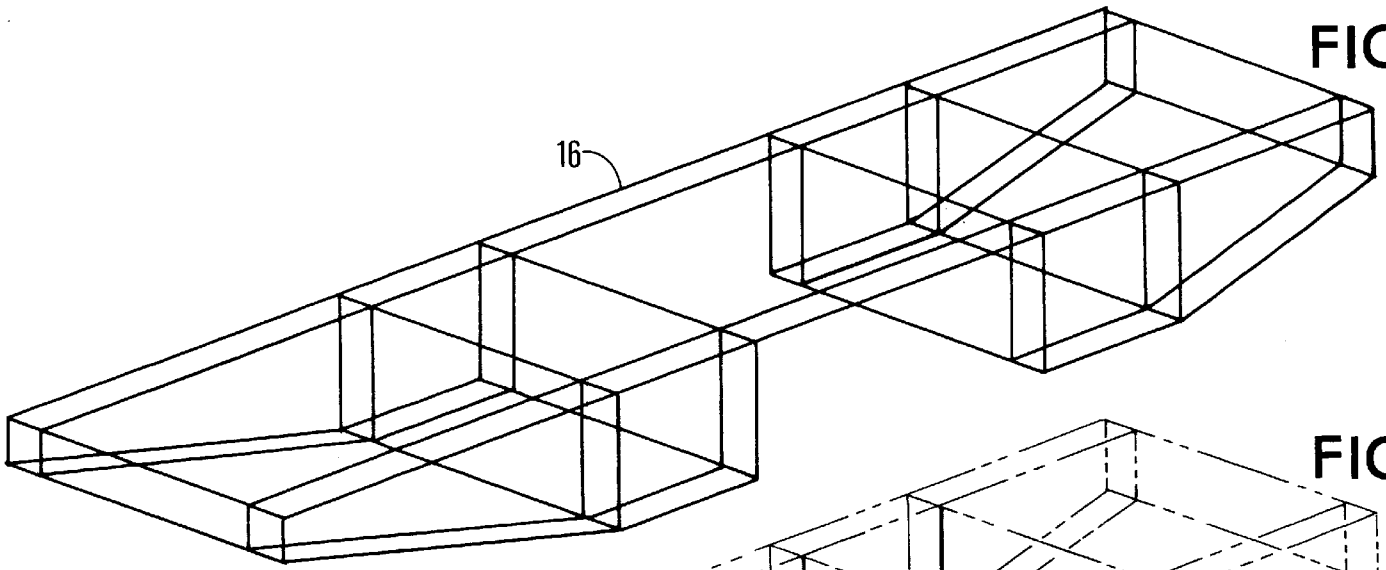
FIG. 6 is a dimetric line-diagram showing the arrangement of the central hull heavy frame.
Figure 7:
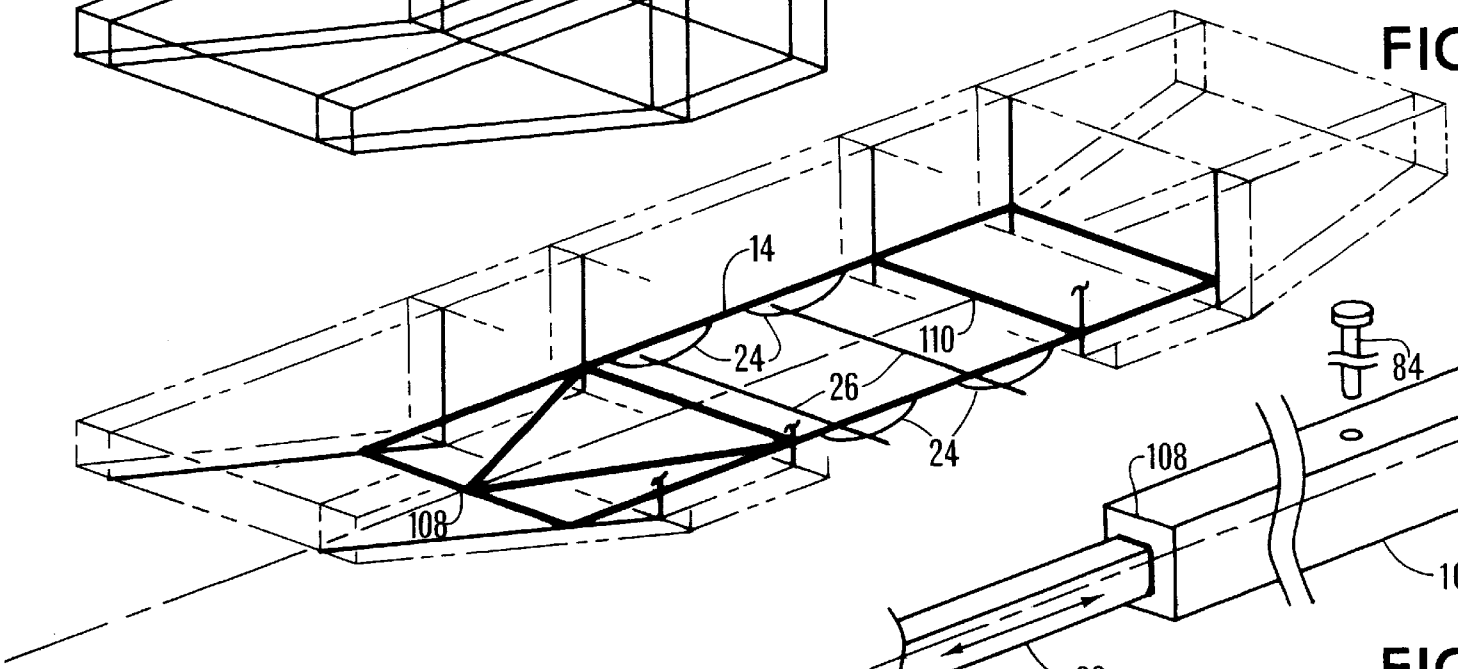
FIG. 7 is a dimetric line-diagram showing the arrangement of the main frame and members of the central hull heavy frame to which the main frame is attached.

FIG. 6 is a dimetric line-diagram showing the arrangement of central hull heavy frame 16 (also partially shown in FIG. 7).

FIG. 7

FIG. 7 is a dimetric line-diagram showing the arrangement of main frame 14 and portions of the central hull heavy frame (fully shown in FIG. 6) to which the main frame is attached. To clarify the main frame's position, phantom lines indicate other heavy-frame members as shown in FIG. 6.

FIG. 7 shows axles 26, and suspension systems 24 (drawn idealized as leaf springs) attaching the axles to the main frame. The centerline drawn partially through the main frame clarifies positions of towing tongue 32 (only FIGS. 1, 3, 4, 5, and 8) and towing tongue housing 106 (only FIG. 8). Additionally indicated for clarity are tongue housing/main frame forward junction 108 (also FIG. 8), and tongue housing/main frame aft junction 110 (also FIG. 8).

FIG. 8

Figure 8:
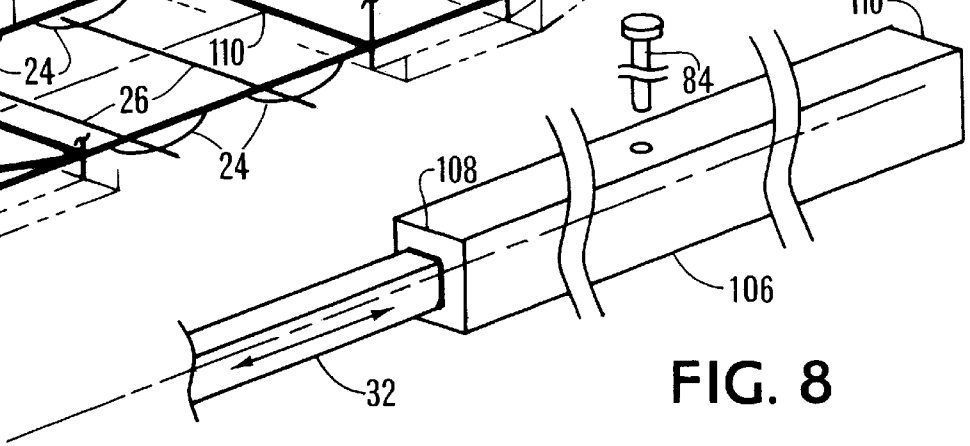
FIG. 8 is a dimetric drawing of the towing tongue, tongue housing, and tongue securing pin.

FIG. 8 is greatly enlarged compared to FIG. 6 and 7, and shortened as indicated by the curved break-lines. Clearance between the towing tongue and its housing is minimal and illustrated only by a thick line.

FIG. 8 is a dimetric drawing of retractable towing tongue 32 (also FIGS. 1, 3, 4, and 5), tongue housing 106, and tongue securing pin 84, indicating tongue housing/main frame forward junction 108 (also FIG. 7), and tongue housing/main frame aft junction 110 (also FIG. 7). The centerline drawn partially through main frame 14 (only FIG. 7) clarifies positions of the tongue/housing and main frame.

Discussion of FIG. 9—Alternative Embodiment

FIG. 9 is an orthogonal port-side view of the land mode of an alternative embodiment of the barge. Hull hinges and hull-lock installations are omitted. FIG. 9 shows removable, fifth-wheel, alternative towing tongue 112, alternative central hull 114, port alternative outboard hull 116, port inflatable bellows 118, and a shipping container drawn in phantom lines.

OPERATION OF INVENTION

As mentioned in the Description of Invention section (particularly the preface), various items are not shown in the drawings. To make the following text more readable, such items are not individually noted "not shown."

Those items include installation sockets of the lifeline posts, kingpost, mast, mast-stabilizing strut, and mast-stabilizing bipod, outboard-hull rigging points, a tow vehicle and its brake and "road light" connections to the barge, mooring lines, fairleads, anchors, on-board loads such as vehicles and equipment, a dinghy, navigation lights other than the masthead and anchor lights, and a lever-action chain binder.

Note: Bold-type numerals in this section pertain to items shown only in FIG. 2 unless noted, for example, 34 (only FIG. 1) or 12 (also FIGS. 1, 3, 4, and 5). This guideline does not apply to the alternative-embodiment discussion in the final paragraph of this section.

The barge is positioned near a launch site. Kingpost 34 (only FIG. 1) is installed upright in its below-deck socket. Each end of wire-rope bridle 38 (only FIG. 1) is rigged through one of two snatch blocks 36 (only FIG. 1) atop the kingpost, and hooked to rigging points on each of hinged outboard hulls 12 (also FIGS. 1, 3, 4, and 5).

A cable from below-deck winch 40 (only FIG. 4) is hooked to the midpoint of the bridle. The cable is winched in, causing the outboard hulls to rotate upward and outward until their center of balance shifts outward. The cable is let out, causing the hulls to rotate downward to their water-mode positions.

Central-hull bow hinged gunwale 72, outboard-hull hinged gunwales 74, and central-hull stern hinged gunwale 76 are pivoted up from the deck and over to positions where they extend ahead or astern as appropriate.

Outboard hulls are secured in their water-mode positions by eight locks 80 (only FIG. 5, the four port locks shown, starboard locks not visible, described in Enclosure 1*a*) accessible through eight access wells 78 (only FIG. 4).

Starboard vehicle ramp 70 and the port ramp (not shown), previously fastened to the inward sides of the un-deployed outboard hulls, were repositioned outward of the hulls when the hulls were deployed. Ramps are rigged to the wire-rope bridle, unfastened from the hulls, and winched aboard.

Lifeline posts 64 are set upright in their below-deck sockets. Port and starboard lifelines 66 and stern lifeline 68 are installed. Then gunwales across the stern are pivoted upright and fastened to the lifeline posts.

The barge is backed into the water and moored behind the tow vehicle. Braking and "road light" systems are disconnected. Towing tongue 32 (only FIG. 1, 3, 4, 5, and 8) is detached from the tow vehicle and retracted into central hull 10 (also FIGS. 1, 3, 4, and 5).

If the vehicle ramps are required to embark a vehicle or equipment, they are skidded forward using winch 40 (only FIG. 4), kingpost 34 (only FIG. 1), and various rigging, and attached to the bow so that they extend onto the shore. If the ramps are not required, or after their use, they are set on edge and fastened to port and starboard lifeline posts 64. That on-edge position allows the ramps to serve as gunwales while conserving deck space. Rigging is detached from the kingpost which is then stowed. If a minimal ramp is sufficient, central-hull bow gunwale 72 may be used.

One or more vehicles and/or cargo are taken aboard, using the ramps or central-hull bow gunwale. If applicable, ramps are stowed using the winch and various rigging. Then the bow lifeline (not shown) is installed.

Control/display panel 58 is already connected by its umbilical cord to fathometer and radar equipment, propulsion/steering units, and various components of ballasting and lighting systems. The panel is taken from machinery compartment 60 (also FIG. 4) and suitably placed, such as on the steering wheel of an on-board vehicle.

If necessary, water is pumped into selected water-ballast tanks 94 (only FIG. 4) and 102 (only FIG. 4) to adjust fore/aft trim and port/starboard list.

Note: Metric dimensions in the next two paragraphs are rounded to the nearest onetenth meter.

Bow compartment 42 (also FIG. 4) contains mast-stabilizing bipod 54 comprising two spars which are 2.1 meters (7 feet) long. They are set into angled sockets at opposite ends of the bow compartment and attached at their tops.

Mast 44 comprises two sections, each being 2.1 meters (7 feet) long, connected by locking mast pivot 52. The mast is removed from the bow compartment, unfolded, and locked into its full length of about 4.2 meters (14 feet). Next it is attached at its base to a pivoting mast-installation socket in the bow compartment. Then it is set upright and attached to the mast-stabilizing bipod. Finally, stabilizing strut 56 is installed from the mast to the centerline of the central hull. Atop the mast are anchor light 46, radar transceiver 48, and masthead light 50.

Gunwales across the bow are pivoted upright and attached to lifeline posts and the mast.

The required navigation lights mentioned in this paragraph are in position at this point and need no installation; they are included here for consistency. Port and starboard sidelights and a stern light are fixed to, respectively, amidships port and starboard lifeline posts, and the centerline stern lifeline post.

Pre-underway checks are done, mooring lines are taken aboard, and the barge is maneuvered by water-jet propulsion/steering units 90 (only FIG. 4).

Other navigation lights carried aboard are mentioned here for consistency. Required navigation lights are displayed from prescribed positions to indicate towing, lost or restricted ability to maneuver, grounding, etc.

The barge may cross or be extricated from shoal water or ground by use of winch 40 (only FIG. 4). In this, wheels 28 (only FIGS. 1, 3, 4, and 5) assist by reducing friction, suction, and risk of hull damage. Propulsion and water-ballast system are employed as appropriate. The winch cable is run ahead or astern through fairleads, using a dinghy if needed. Then the cable is attached to a fixed object, or to the anchor(s) which may be set into the ground or dropped from the dinghy. The cable is drawn in and the sequence is repeated as necessary.

Prior to entering contaminated water, such as at a hazardous material release, extra water is pumped into water-ballast tanks 94 (only FIG. 4) and 102 (only FIG. 4). This permits on-site adjustment of trim and list, without taking contaminated water into the tanks. Instead, clean water is discharged.

Water ballast is adjusted as necessary to improve stability in adverse winds, waves, and currents.

Landing procedures and preparations for road towing are essentially the reverse of launching procedures and preparations for waterborne operation.

As outboard hulls 12 (FIGS. 1, 3, 4, and 5) are returned to their land-mode positions, a conventional lever-action chain binder is used to shift the hulls' center of balance inward. For that inward shifting, the chain binder is hooked to rigging points on the aft ends of the outboard hulls.

"Pre-road" checks are done and the tow-vehicle/payload/barge combination is operated as a conventional truck and trailer.

The combination complies with vehicle/trailer regulations for length, width, height, weight, and axle spacing on all but a few interstate highways, national-network highways, and public roads. The alternative embodiment discussed next similarly complies.

In the alternative embodiment of the barge, shown in FIG. 9, removable fifth-wheel towing tongue 112 replaces retractable towing tongue 32. This allows alternative central hull 114 and alternative outboard hulls 116 to be about 1.1 meters (3 feet) longer. Outboard hulls are inset so that a shipping container, having a length of about 6.1 meters (20 feet) and height of about 2.6 meters (8.5 feet), can be carried on land. The shipping container's position is indicated by phantom lines in FIG. 9. A portable gantry (not shown) suspends the container while the barge is rigged out. Then the container is set on the barge or on a truck to be carried aboard. Prior to launch, port inflatable bellows 118 and its starboard counterpart are pressurized using an on-board air compressor (not shown). The inflatable bellows compensate for outboard-hull flotation which was reduced by the insets for the shipping container.

CONCLUSION, RAMIFICATIONS, AND SCOPE OF INVENTION

Conclusion

The road-towed self-propelled barge can transport afloat its tow vehicle and substantial loads as an intact unit, and do so in a comparatively safe, cost-effective manner.

The barge's ability to deliver relatively-heavy emergency equipment from the most expedient launch point, despite adverse conditions, greatly enhances protection of human life and property.

Significant uses and benefits of the barge include: (a) better monitoring and protection of wetland and wildlife areas, (b) reuse of idle farmlands and abandoned mineral sites not presently economically accessible, (c) reduction of costs, terrain damage, and fuel-combustion pollution related to conventional marine operations. Further uses include scientific, military, and commercial expeditions, as well as educational and recreational endeavors.

Various features provide personnel safety, seaworthiness, and the ability to cope with unfavorable situations. Such features include perimeter lifelines, gunwales to reduce deck washover, and closed-cell foam in flotation compartments and outboard hulls. The water-ballast system counterbalances on-board loads and otherwise improves stability in adverse winds, waves, and currents. The water-ballast system, winch, intact wheels, and other equipment assist in crossing or extrication from shoal water or ground.

The barge's extensive use of conventional items and installations in a relatively simple design reduces construction, maintenance, and repair costs and complications.

Ramifications

The road-towed self-propelled barge could be made smaller for recreational pursuits, a major focus of prior art. Scout vehicles of expeditions could also use smaller versions of the barge.

More importantly—the barge could be made larger. The water-mode width of the barge could be increased, without increasing its land-mode width, by two additional outboard hulls stacked on those of the preferred embodiment in its land mode. Additional hinges connecting the adjoining inboard edges of each stacked pair would enable each pair to be deployed and retrieved essentially as discussed in the "Operation of Invention" section.

A longer, heavier barge could be towed by a shorter, lighter vehicle on most public roads and not need special permits. Larger versions of the barge could be transported with permits.

Operations not requiring use of public roads could employ even bigger A units. Those units would retain major advantages of the presented invention and could be disassembled and/or reconfigured for road transportation.

Variations include different materials, shapes, and arrangements of barge components, and substitution, omission, or addition of features.

Waterborne maneuvering could be effected by engines, turbines, power takeoffs, or other energy sources, propellers, rudders, etc. Control and monitoring of the barge and its equipment could be done in numerous ways.

Hulls could be streamlined and more than one central hull could be used. Extendible hull-platforms could increase the deck space.

Outboard hulls could be held in their water-mode positions (or additionally secured) by movable beams fastened across the deck of the barge. Deployment and retrieval of the outboard hulls could be done by various mechanical, electrical, and hydraulic devices, or combinations thereof.

Road-towing equipment could be redesigned. More or fewer axles and/or wheels could be used. The leaf springs could be replaced by coil springs, torsion bars, air bags, etc. A detachable "A-frame" towing tongue, comprising one or more members, would provide a stronger towing system. In lighter-weight barges, a movable or pivoting towing tongue could also serve as part of the mast.

Ballast tanks could be filled by a system of flood and vent valves, emptied by air pressure, and/or located elsewhere, such as in the outboard hulls.

Other tanks and compartments could be repositioned. Fixed or movable inflatable bladders attached to the barge could increase flotation and stability.

The kingpost and lifeline posts could be equipped with pivoting bases. The mast and vehicle ramps could be installed and stowed in various ways. Vehicle ramps could be hinged or separable at their midpoints to ease handling and enable their use in half-length.

Scope

As discussed above, many changes and different embodiments of the road-towed self-propelled barge could be made without departing from the spirit and scope thereof. Accordingly, it is intended that all matter contained in this application be interpreted as illustrative and not limiting.

SEQUENCE LISTING

Not Applicable.

I claim:

1. A road-towed ferry capable of ferrying a heavy load and having a bow and a stern, comprising:

a. a central hull with an upper deck surface, outboard surfaces, a bow portion, a stern portion, a fore-and-aft midpoint, and a centerline with a midpoint;

b. bow and stern compartments positioned at locations at each of the bow and stern portions of said central hull, respectively, the bow compartment being adapted to couple to a fathometer transducer;

c. a plurality of water-ballast tanks each being positioned at a location along said central hull and excluding the bow and stern compartments along the central hull, respectively;

d. a winch compartment disposed across the centerline of said central hull and adjacent to said bow compartment;

e. a machinery compartment located primarily aft of the fore-and-aft midpoint of said central hull along its centerline, said machinery compartment having sufficient dimension and construction to house at least one jet propulsion unit and being adapted to allow a housed jet propulsion unit to couple to a battery bank and to a steering unit;

f. wheel wells outboard of said machinery compartment;

g. a main fuel tank forward of said machinery compartment;

h. a plurality of outer fuel tanks located within a region bounded by an outboard surface of said central hull, a wall of each of the wheel wells, a respective wall of each of the water-ballast tanks, and a portion of a forward main flotation compartment;

i. said forward main flotation compartment being located within a region bounded by respective walls of the water-ballast tanks, a wall of said main fuel tank, and a wall of said bow compartment;

j. an aft main flotation compartment located within a region bounded by a wall of said machinery compartment, a wall of said stern compartment, and respective walls of the water-ballast tanks;

k. a plurality of outer flotation compartments each being located within a region bounded by an outboard surface of said central hull, a wall of one of said wheel wells, a wall of a respective one of said water-ballast tanks, and a portion of said machinery compartment.

2. A road-towed ferry capable of ferrying a heavy load, comprising:

a. a central hull with a winch compartment;

b. a plurality of outboard hulls coupled to the central hull;

c. at least one of the central and outboard hulls having a structure primarily comprising plate material coupled to a hollow framework;

d. a kingpost that is removable from an installed position substantially along the centerline and longitudinally substantially medial of said central hull;

e. a winch installed in the winch compartment in said central hull and cooperating with said kingpost; and f. wherein said kingpost and winch are adapted to deploy and retrieve said outboard hulls.

* * * * *